United States Patent [19]

Curran et al.

[11] Patent Number: 4,775,352

[45] Date of Patent: Oct. 4, 1988

[54] TALKING DOLL WITH ANIMATED FEATURES

[75] Inventors: Kenneth J. Curran, Thousand Oaks; Richard L. May, Manahattan Beach, both of Calif.

[73] Assignee: Lawrence T. Jones, Culver City, Calif.

[21] Appl. No.: 827,791

[22] Filed: Feb. 7, 1986

[51] Int. Cl.[4] ..... A63H 3/28; A63H 3/40; G03B 21/32

[52] U.S. Cl. ..... 446/301; 446/344; 446/299; 352/87

[58] Field of Search ..... 446/175, 138, 303, 342, 446/353, 348, 301, 299, 298, 297, 300, 343, 344; 352/54, 87

[56] References Cited

U.S. PATENT DOCUMENTS

| | | | |
|---|---|---|---|
| 2,220,719 | 11/1940 | Jentzen | 446/348 X |
| 2,641,866 | 6/1953 | Schiller | 446/300 X |
| 3,100,949 | 8/1963 | Brenneman | 446/138 |
| 3,131,497 | 5/1964 | Rogers | 446/302 X |
| 3,315,406 | 4/1967 | Ryan | 446/302 X |
| 3,662,374 | 5/1972 | Harrison, III et al. | 352/87 X |
| 4,177,589 | 12/1979 | Villa | 446/175 X |
| 4,221,927 | 9/1980 | Dankman et al. | 446/297 X |
| 4,660,033 | 4/1987 | Brandt | 446/299 X |

FOREIGN PATENT DOCUMENTS

| | | | |
|---|---|---|---|
| 560811 | 10/1923 | France | 446/348 |

*Primary Examiner*—Robert A. Hafer
*Assistant Examiner*—D. Neal Muir
*Attorney, Agent, or Firm*—Price, Gess & Ubell

[57] ABSTRACT

An animated audio doll whose mouth can be driven by replaceable tape cartridges is provided. The doll has a head member with simulated eyes and mouth that can open and close. Uni-directional direct current motors are provided in the body of the doll and are connected to the respective eyes and mouth through flexible driven links that protect the motor if either the eyes or the mouth are held stationary. The tape cartridge can be encoded with audio signals, a base frequency and a pair of coordinated frequency timing signals. The tape player can convert the frequency timing signals into digital signal levels while a binary switch member can determine when the mouth is in a closed position. A level detector circuit can determine whether the first or second timing signals are present and a logic circuit can, in combination with the timing signals and the output from the binary switch, drive the DC motor connected to the mouth in coordination with the audio sounds. A separate motor can drive the eyes in coordinated movement in a vertical and horizontal direction to contribute to the realistic simulation of an animated object.

35 Claims, 5 Drawing Sheets

TALKING DOLL WITH ANIMATED FEATURES

BACKGROUND OF THE INVENTION

1. Field of the Invention

The present invention relates to an animated audio doll for simulating a living object with audio-visual characteristics, and more particularly to an economical animated doll that can be manufactured and assembled within minimal cost and production tolerance constraints.

2. Description of the Prior Art

People in general and children especially are fascinated when an inert object, such as a doll, can be animated to provide lifelike characteristics, such as moving eyes and mouth with the coordination of sound. An early example in the patent literature can be found in U.S. Pat. No. 2,114,851 wherein a ventriloquist's dummy is disclosed with coordinated eye and mouth movement. Subsequently, animated figures were coordinated with sound and with motors to move various parts of the body, such as disclosed in U.S. Pat. No. 2,711,603 wherein a motorized mannequin is capable of changing facial expressions including the movement of its mouth. Another example can be found in U.S. Pat. No. 2,641,866 wherein a mechanized movable doll could also incorporate a sound producing mechanism to simulate a voice. Numerous examples exist of animated sounding toys, such as dolls, wherein a synchronization of a sound producing device is coordinated with the movement of both a mouth or a pair of lips and eyes, such as U.S. Pat. No. 3,230,665, U.S. Pat. No. 3,264,778, U.S. Pat. No. 3,210,887, U.S. Pat. No. 3,353,296, and U.S. Pat. No. 3,364,618. The latter two patents represent the work of one of the present inventors and disclose a phonograph player in the trunk of a doll that would produce sounds that could be coordinated with both movable eyes and a mouth to produce a lifelike animated doll. The prior art is also aware of the alternative use of tape players with replaceable tape cartridges instead of phonographs positioned in the body of a doll to produce audible sounds with appropriate synchronization of the mouth movement, such as shown in U.S. Pat. No. 3,287,849 and U.S. Pat. No. 3,685,200. It has also been known to encode a tape cartridge with control signals coordinated with audio signals in slide projectors and toys.

The rapid advancement of relatively inexpensive electronic component parts plus the miniaturization of electronic parts have permitted doll designers to design complex motions and sounds to be generated in dolls and other toys, such as robots. For example, U.S. Pat. No. 4,451,911 discloses a microprogrammable doll with audio features.

Finally, various amusement parks have provided animated figures with coordinated body movements and audio sounds from tape players controlled through servo feedback systems that monitor the position of the moving components.

Thus, the ability to either combine a phonograph unit or a tape player with synchronized mouth and eye movements has been common knowledge in the toy field for over 20 years. The allure of more sophisticated miniaturizing of electronics that are well known in the toy industry has encouraged the manufacturers to make more complex and elaborate animated audio toys, such as robot toys and dolls that can provide a number of toy play options to children.

While technology has become more sophisticated and the dissemination of this information is commonplace in the toy field, the ultimate user of the product is still a relatively young child. Thus, numerous sophisticated features may be appealing to an adult in buying the toy, but there is still a limitation as to the amount of money that the average purchaser is willing to spend on a luxury item, such as a toy. Additionally, children require a relatively rugged and tolerant toy that will not only function on its first day of purchase, but will be able to withstand the rigors of prolonged child's play.

Thus, there is still a demand in the toy field for a relatively economical, animated audio doll having an easily manufactured structure with relatively loose tolerance specifications to permit variables to occur without affecting the performance of the doll and that further can be subject to the relatively rigorous demands of the child during play.

SUMMARY OF THE INVENTION

The present invention is both an improvement and a simplification of the known animated audio doll toys that have moving eyes and coordinated mouth and audio production from a self-contained tape player in the body of the doll. The doll's head can be mechanized to provide an apparent random movement of the eyes in both the vertical and horizontal plane and can further provide a coordinated movement of the doll's mouth with the production of characteristic sounds symbolic of the living object represented by the doll, such as a little boy or girl. The eyes are mounted in a simulated head member to provide the coordinated vertical and horizontal movements and are driven through a series of gears and flexible links interconnected with timing cams and followers. Inexpensive uni-directional direct current (DC) motors can serve as the prime movers. The linkage system from the cam follower to the eyes includes elongated flexible links that are relatively rigid during the normal driven movement of the eyes but have a specific design flexibility and are positioned within a path of unrestrained freedom of movement to bend sufficiently to absorb the driven displacement if the eyes are restrained from movement, thereby protecting an overload on the DC motor. An equivalent flexible linkage can also be utilized to move the mouth and preferably a separate uni-directional DC motor drives the mouth.

A cassette tape player of a conventional compact configuration is mounted within the trunk of the doll body and can receive replaceable magnetic tape cassettes that are encoded with both fixed level frequency timing signals on one track and audio sounds on a separate track. The tape cassette can consist of only a pair of encoded timing signals providing a first and second fixed frequency level above a threshold base frequency to control the mouth movement. The base frequency is set below the operative range of the timing frequencies to improve the control circuit response time. These fixed frequency timing signals can be converted to digital signal levels that can drive the mouth motor to either an "on" or "off" state.

A pair of pickup heads can be used, one to sense the audio signal which is subsequently pre-amplified and provided to a driver circuit to drive the audio speaker in the doll body, while the other pickup head senses the fixed frequency timing signals that are pre-amplified and applied to a zero crossover detector circuit for digitizing the sensed timing signals. A differential circuit is provided for quantizing the sensed timing signals and a subsequent integrating circuit integrates the timing signals to voltage levels. A level detector circuit means is provided for distinguishing between the first and second level timing signals, while a logic circuit is utilized to apply either the first level timing signal to the mouth motor and to a binary feedback switch, which can indicate if the mouth is in a closed position, or a second level timing signal, which is supplied in a parallel manner to the mouth motor to continually drive the mouth in a cyclically open and closed fashion regardless of the state of the binary feedback signal from the switch and the presence of the first level timing signal. Ordinary DC batteries can be used without voltage regulation since the signal processing of the binary digital signals take into account the wide variance in power output of relatively inexpensive battery supplies.

The features of the present invention, which are believed to be novel, are set forth with particularity in the pending claims. The present invention, both as to its organization and manner of operation, together with further objects and advantages thereof, may best be understood by reference to the following description, taken in conjunction with the accompanying drawings.

DETAIL DESCRIPTION OF THE PREFERRED EMBODIMENTS

Figure 1:
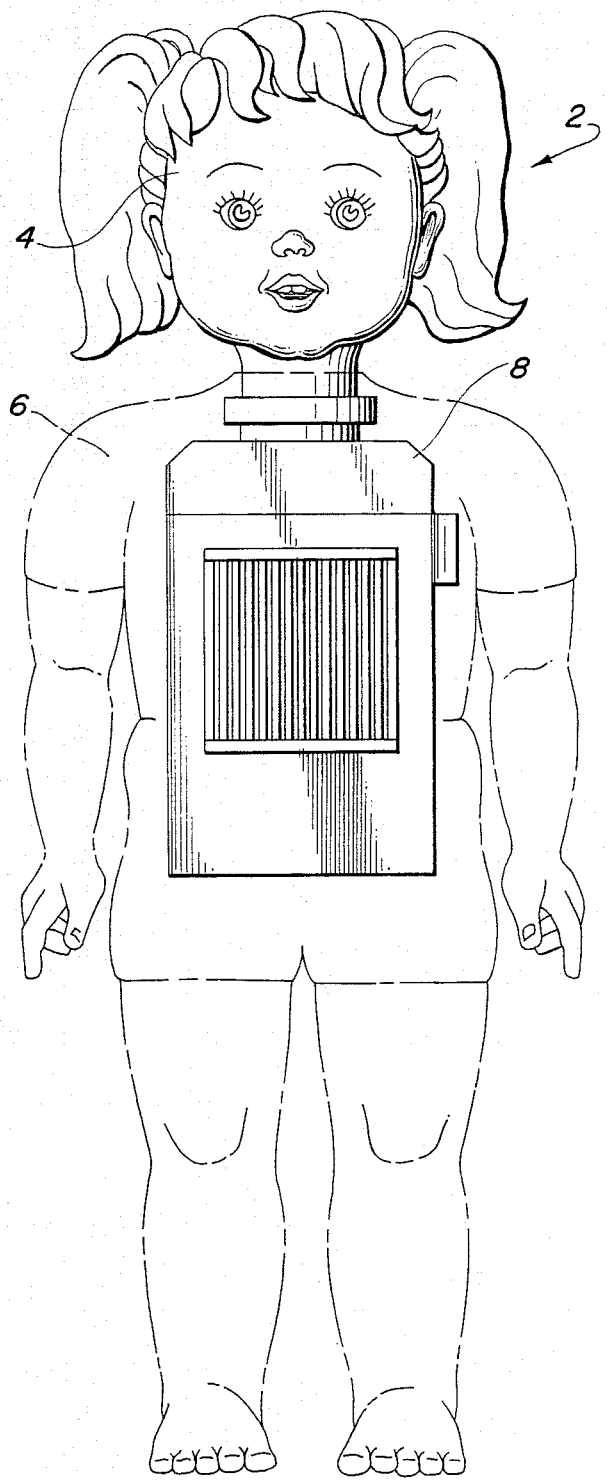
FIG. 1 is a front elevational perspective view of the present invention in the form of a doll head and tape player of the present invention.

The following description is provided to enable any person skilled in the toy and electronic industry to make and use the invention, and it sets forth the best modes contemplated by the inventors of carrying out the invention. Various modifications, however, will remain readily apparent to those skilled in the above art, since the generic principles of the present invention are applied herein specifically to provide a relatively economical and easily manufactured animated figure with coordinated audio response, such as a talking toy doll.

The present invention is directed to provide an animated figure, such as a male or female toy doll. The toy doll has subjective facial design characteristics that are not part of the present invention. Flexible skinlike doll heads containing mechanisms for moving the eyes of a doll and the mouth of a doll in coordination with sound are disclosed in the earlier work of one of the present inventors in U.S. Pat. No. 3,364,618 and U.S. Pat. No. 3,353,296. The present invention represents a further improvement in simplifying the production cost of such animation mechanisms.

Additionally, while the toy field has for a considerable period of time been aware of the use of tape players and tape cassettes for both producing an audible voice in coordination with the control of motors, for example, to provide movement of the parts of the face, such as the mouth and eyes, there has been a recent tendency to complicate such mechanisms by providing an extremely elaborate microprocessor system and precise servo-sensing circuits. The present invention recognizes that such complexity not only increases the cost of the product but also increases the ability of the product to fail without significantly increasing the desirable play action for the child. Thus, a goal of the present invention is to simplify a talking animated doll that is driven by a tape player so that a rugged durable doll is provided that can be easily manufactured while retaining the essential play action features desired by the child. In accomplishing this purpose, the present inventors determined that a true or complete synchronization of mouth movement to duplicate the actual movement of a living object, such as a person, is not necessary to achieve the essential play action feature of the present invention. It has been decided as a design parameter of the present invention, that movement of the mouth during the production of an audible sound and conversely stopping of the movement of the mouth with the cessation of sound is the key feature and is sufficient to provide the essential play action feature desired by a child. Empirical observations by the inventors have noted that an observer assimilates the visual appearance of the movement of the mouth during the sound production which causes the observer to mentally coordinate the effect to the inanimated object and to perceive an animated, lifelike object. Thus, if the mouth is in motion in coordination with the starting of the sound and the mouth stops in coordination with the stopping of the sound, the essential play feature desired can be provided by the toy. Additionally, random eye movement heightens the lifelike perception of the observer.

While it should be appreciated that the present invention can be utilized in various forms of simulated, animated objects, such as mannequins, animals, amusement display devices, robots, etc., the present invention in the preferred embodiment will be described hereinafter with regard to a toy doll, such as a simulated little girl or little boy.

Accepting the above design parameter, the present inventors have proceeded to further provide mechanisms that will protect the uni-directional motors of the present invention from the natural curiosity of children, e.g. touching or holding fast the moving portions of the head, such as the mouth or the eyes, and have further provided a unique simplified encoding system that takes into consideration manufacturing tolerances in various tape players and the effect of relatively inexpensive battery supplies in the movement of the tape player.

Referring to FIG. 1, a female toy doll incorporates the present invention. A head member 4 is connected to the trunk 6 of the doll and can further support appropriate articulated limbs. The doll can be of any size that is large enough to contain the tape player mechanism, motors, transmission gears, etc. that are mounted within the housing member 8. The torso or trunk of the doll can have an appropriate cavity with an opening, usually positioned on the rear body of the doll, to accomodate and hold the housing member 8 with appropriate access to controls for turning the doll on and inserting and replacing tape cartridges. As can be readily appreciated, the clothing of the doll is usually designed to accomodate access to the tape player while covering the doll body to maintain the desired appearance to the child. The doll body itself may be rigid or flexible, depending upon the particular utilization of the toy, however, the doll head is preferably formed of a soft flexible plastic shell.

Figure 7:
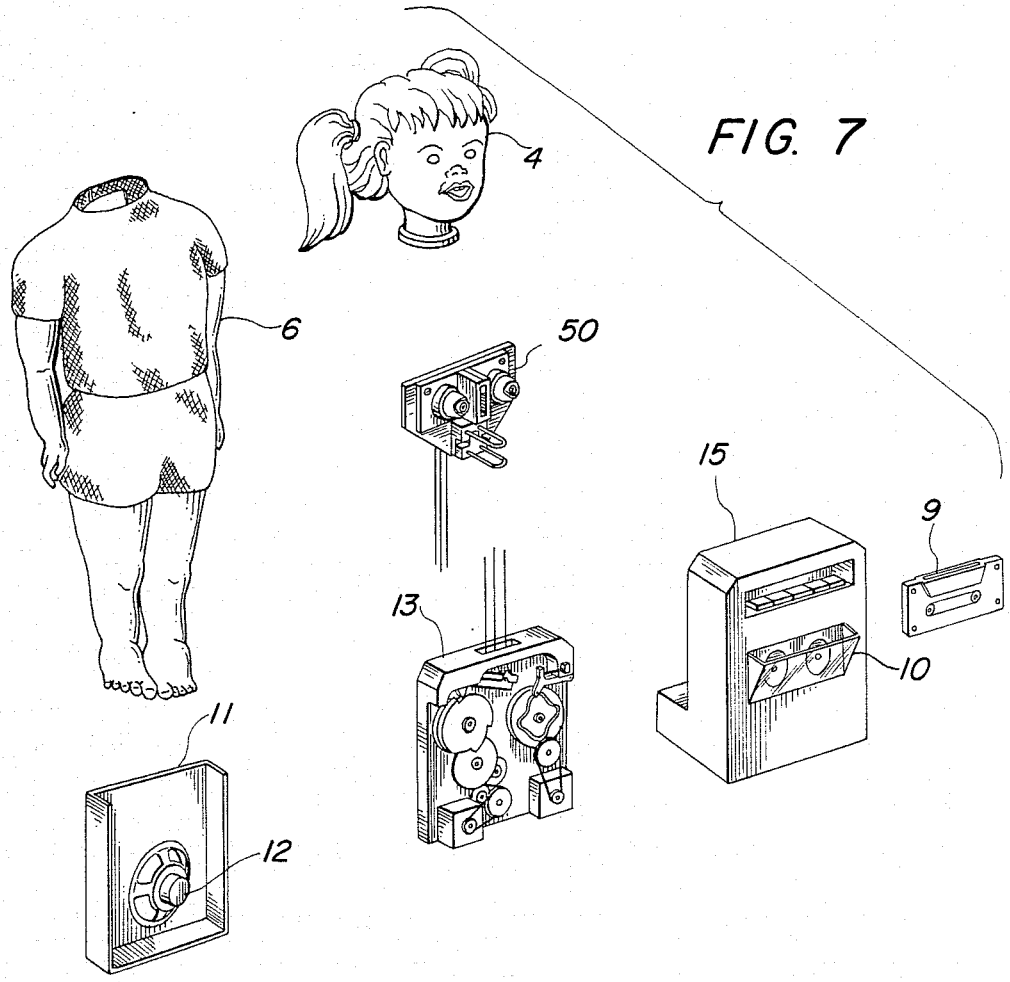
FIG. 7 is an exploded schematic disclosing the subunits that comprise the parts to be assembled for manufacturing.

Mounted within the housing member 8 is a tape player 10, shown in FIG. 7 that can accomodate replaceable magnetic tape cartridges 9. A power supply, such as four C batteries 14, see FIG. 5, is mounted within the housing member 8 and is also accessible from the rear of the doll body 6. The specific tape player 10 is of a conventional design and consists essentially of a pre-amplifier and a driver circuit or audio amplifier to drive the speaker 12. One embodiment of the audio circuit is disclosed schematically in FIG. 5, but it should be understood that circuits used in conventional tape recorders and tape players could be utilized. As can be seen, the pre-amplifier is transistorized to provide a lower current drain on the power supply as is known and appreciated by a person of ordinary skill in this field. Additionally, the driving of the magnetic tape through a motor 16 with appropriate capstans and speed governors are well known. A magnetic tape is preferably contained in a self-enclosed cassette housing 9 (FIG. 7) and in the preferred embodiment of the present invention includes a pair of recording tracks with one track dedicated to the audio sounds that are to be picked up by the stereo head or transducer 18 and the other track to be picked up by the encoding head or transducer 20.

Referring again to FIG. 7, the speaker 12, of a conventional design, is mounted on cover member 11 while the gears and motors are mounted on a support plate 13. The tape player forms a rear portion 15 of the housing member 8. As can be readily appreciated, by forming these parts of the invention in sub-units, manufacturing assembly can be easily accomplished.

Figure 3:
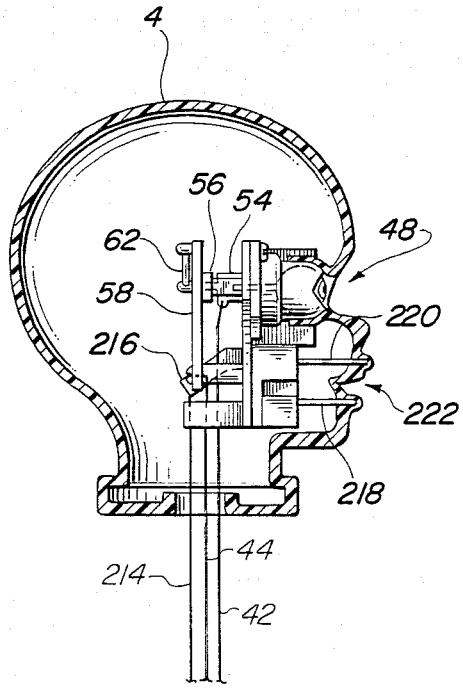
FIG. 3 is a vertical, cross-sectional view of the apparatus of the present invention in combination with a toy in the form of a doll.
Figure 2:
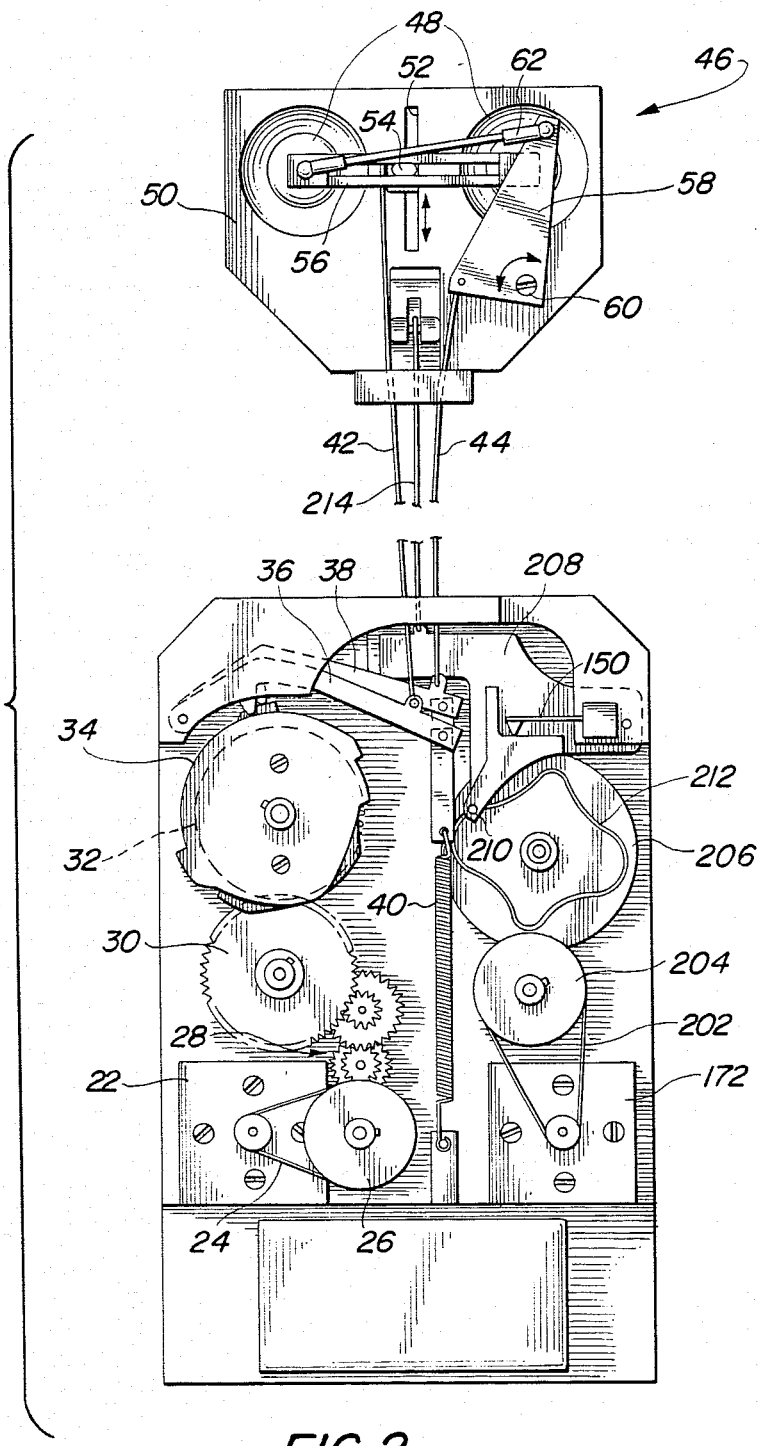
FIG. 2 is a plan view of the power transmission to the eyes and mouth with the eye mounting bracket rotated 180° from its normal position relative to the lower motors for illustration purposes.

Referring to FIGS. 2 and 3, a schematic of the mechanisms for moving the simulated eyes and mouth is disclosed. Motor 22 for the eyes is a uni-directional DC motor of a conventional design and is independent of the mouth motor 172. It is connected through a speed reducer belt 24 to a pulley and pinion gear combination 26. An appropriate gear train assembly 28 drives an output gear 30. The gears can be molded of plastic and preferably are designed to minimize any noise. The output gear 30 of the gear train assembly 28 meshes with gear teeth 32 on a compound cam assembly 34. A pair of separate camming surfaces are provided in parallel planes on the cam member assembly 34 for rotational contact with respectively pivoted cam follower levers 36 and 38. The rotational movement of the cam member 34 is turned into a pair of linear displacements that will vary upon rotation, depending on the cut of respective cam tracks. A pair of springs 40 bias the respective cam followers against their respective camming surfaces on the cam assembly 34. The cantilever end of each of the cam followers 36 and 38 are respectively attached to flexible links 42 and 44. These flexible links are relatively rigid during normal operation to transmit the variable displacement of the respective cam followers 36 and 38 to pivotable links in the eye mechanism 46. Links 42 and 44, however, have a specifically designed flexibility to bend sufficiently to absorb the driven displacement at any point along the cam surface if the doll's eyes 48 are restrained during operation. That is, if a child holds the eyes stationary, the links will bend rather than bind the followers 36 and 38, and the spring force in the links do not provide a sufficient torque load on the gear assembly that would adversely effect the motor 22. The flexible links 42 and 44 are also positioned to extend into the doll head 4 along a path of unrestrained freedom of movement to accomodate any possible bending. Preferably, the links 42, 44 and 214 are formed from nylon and are not positioned within any restraining casing.

One cam surface controls the vertical displacement of the eyes 48 while the other cam surface controls the horizontal displacement of the eyes 48. As can be seen from FIGS. 2 and 3, the eyes 48 are subject to a compound motion as they reside in the flexible sockets of the head member 4. A support plate 50 is fixedly mounted in the doll head 4 and includes a vertical slot 52 that accomodates a pin member 54 that supports a tie bar 56. Movement of the flexible link 42 can displace the pin 54 vertically along the slot 52 which in turn carries the tie bar 56 that is connected at either end to a respective eyeball. The connection with the tie bar 56 and the eyeballs 48 are such that the eyeballs can only rotate about an approximately vertical axis, when the tie bar 56 is displaced in a horizontal direction. When the tie bar 56 is displaced by the pin 54 in a vertical direction, the eyeballs 48 must also rotate about a horizontal axis to follow the displacement of the tie bar. Since the tie bar 56 provides a parallel linkage to each of the respective eyeballs 48, they will move in unison and can both look up and down in a vertical direction while sweeping horizontally depending upon the desired cam path configuration that is provided on the cam assembly 34.

A pivot plate or bellcrank 58 is attached to the horizontal flexible link 44 and rotates about the pivot point 60. At the upper end of the bellcrank 58, a tie rod 62 is connected through a ball joint at one end and to the tie bar 56, through another ball joint, at the other end. Since the tie bar 56 has a horizontal slot, displacement of the bell-crank 58 by the flexible link 44 permits the tie bar 56 to be displaced and to move each of the respective eyes 48 in unison. Thus, a horizontal sweep of the eyes can be efficiently provided. The use of these flexible links 42 and 44 rather than conventional cables mounted in a casing provides significant safety and rugged construction features that can withstand the rigors of child play. As can be appreciated, a compound motion is provided to the eyes to simulate a realistic appearance.

Figure 5B:
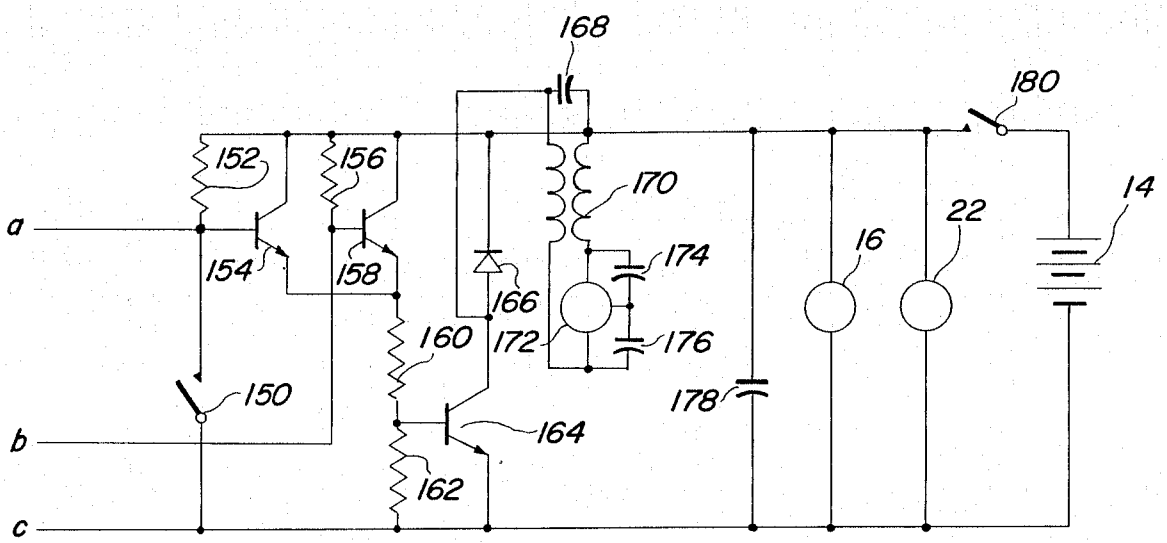
FIGS. 5*a* and 5*b* form a circuit diagram showing the details of the audio and control circuit of the present invention.
Figure 5A:
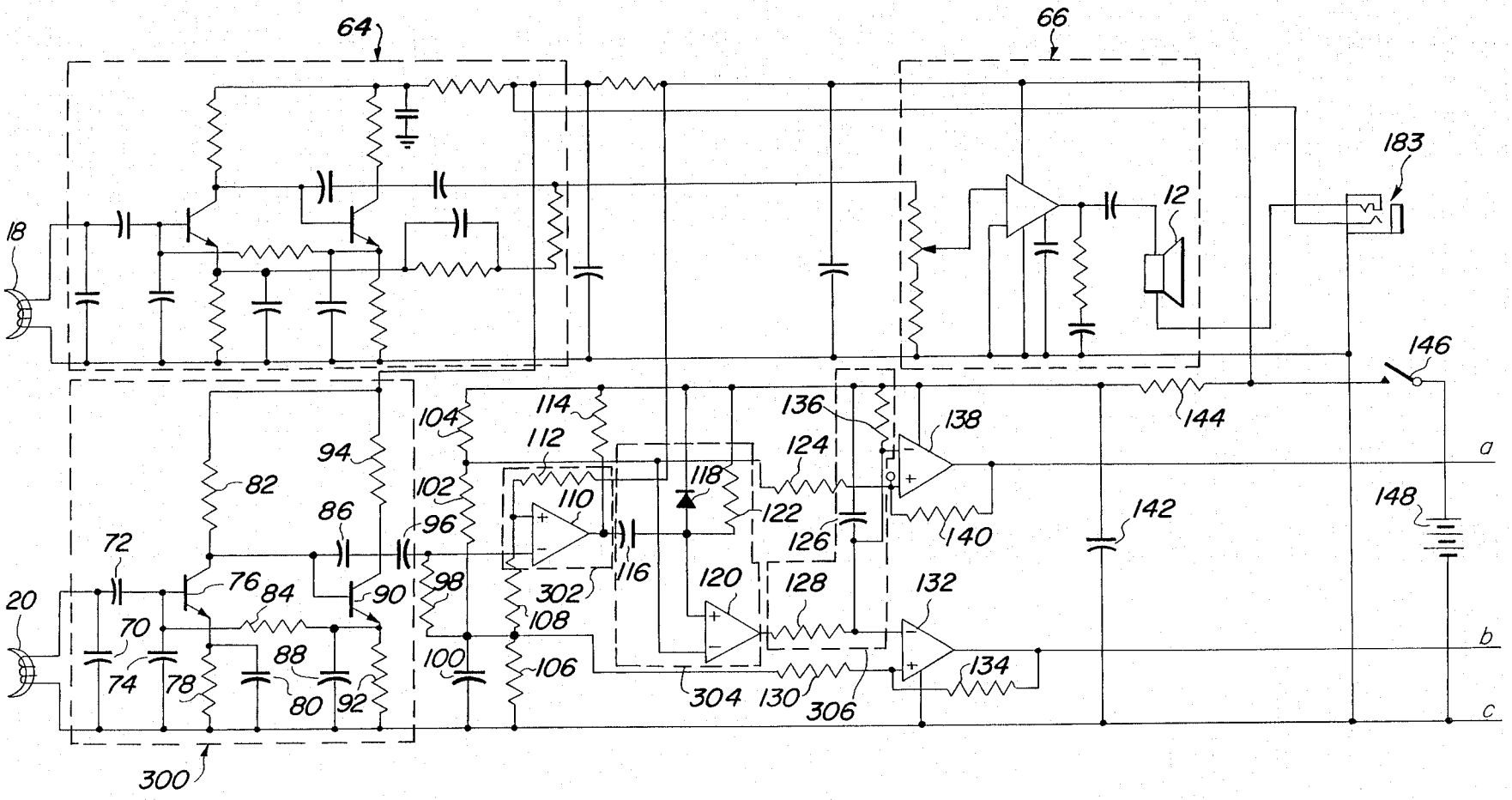

Referring to the circuit diagram of FIGS. 5*a* and 5*b*, the audio track of the magnetic tape is picked up by the stereo head 18 and a pre-amplification is provided by portion 64 of the audio circuit in a known manner. The final audio amplification to drive the speaker 12 is provided by the circuit portion 66. Specific details of this audio circuit are standard and do not form an essential part of the present invention, and accordingly a detailed discussion will be omitted since these audio circuits can be easily understood by persons skilled in this field. The connector 183 permits attachment of an accessory which is not part of this invention.

The control circuit for driving the eyes 48 and the mouth 222 will now be described. In this regard, it should be appreciated that the motor 22 that drives the eyes 48 is not controlled by encoded frequency level signals on a magnetic tape but rather is continuously on when power is applied through switches 146 and 180 and relies upon the predetermined camming surfaces on the cam assembly 34 to provide an apparent random movement of the eyes 48. Thus, when the "on" switch for the doll is activated both switches 146 and 180 are closed and the eyes 48 will commence to move regardless of the presence of a tape cassette 9 in the tape player 10. As can be readily appreciated, the provision of an independent motor and driving mechanism for the eyes 48, separate from that for the mouth, insures a continuation of this play action feature for the doll even if the motor 172 for the mouth 222 should become inoperative. The pickup head 20 senses a timing frequency level signal encoded on the tape and provides an input signal to the control circuit via the capacitor 72. The capacitor 70 reduces high frequency noise as does capacitor 74. The transistor 76 is biased by the resistor 84 and the emitter resistor 78 which is decoupled by the capacitor 80. An amplified signal is developed across the resistor 82 and is coupled to the second stage of amplification directly to transistor 90. Transistor 90 is biased via resistor 82 and its emitter resistor 92 which is decoupled by capacitor 88. This amplified signal is then developed across resistor 94 which is coupled through a capacitor 96 to a comparator 110. Capacitor 86 is used for high frequency stability between the emitter and base of the transistor 90. The output signal is coupled through capacitor 96 to a comparator 110 and is developed across resistor 98 which is connected to a voltage divider comprised of resistor 102, 104, and 106. The voltage divider establishes a bias level for the comparator 110. The comparator's threshold is set to the same reference voltage, i.e. the junction of resistor 102 and 106. Therefore, its output transitions occur at the zero crossings of the input signal from the pre-amplifier.

Resistor 112 is used to provide hysteresis for the comparator 110 to improve the transitions. The output signal from comparator 110 is developed across pull up resistor 114. This signal is differentiated by capacitor 116 and developed across resistor 122. The signal at the output of comparator 110 is essentially a square wave of the same frequency as the input signal. The diode 118 is used to clamp this differentiated signal to prevent the voltage from exceeding the limitations of a comparator 120. The comparator 120 has an output signal which provides equal length pulses for each negative transition of the output from comparator 110. The output of comparator 120, being an open collector comparator, is passed through resistor 128 to integrating capacitor 126. There is a discharge resistor 136 across the capacitor 126 which is used to integrate the string of pulses as the output from comparator 120 to a DC voltage level.

In the level comparison detector 308 and 310, this voltage level is applied to comparators 132 and 138. These comparators are biased by the voltage divider 102, 104, 106. The voltage at the inputs to these comparators 132 and 138 are developed across the capacitor 126 as a voltage which decreases as the frequency increases, therefore, a lower frequency input will result in a higher voltage. When the input frequency reaches to a point where the input to comparator 138 is below the threshold voltage established by resistor 124, the comparator's output becomes open. Elements 110, 120, 132, and 138 can be sections of one quad comparator. In the same manner, when the voltage at the junction on the integrating capacitor 126 becomes lower, i.e., the frequency is higher, the voltage will exceed the threshold of comparator 132 and the output of 132 will also become an open circuit. The transitions of these comparators are improved through the hysteresis generated by resistors 140 and 124 for comparator 138 and resistors 134 and 130 for comparator 132. Entering the logic circuit 312, the output signal from comparator 138, which is either an open circuit or a pull down, is connected to the resistor 152. When the comparator's output is at a high impedance, current is passed through resistor 152 via transistor 154 to supply current through resistor 160 to transistor 164 which will turn on the mouth motor 172. However, even though the comparator 138 may be in an open circuit state, if switch 150 is closed, transistor 154 will remain off, regardless of the state of the output of comparator 138. In a like manner, when the output of comparator 132 is at a high impedance, current is passed via transistor 158 to supply current through resistor 160 to transistor 164 which will turn on the mouth motor 172, thus completing the function of the logic circuit 312. Capacitors 168, 174 and 176 and the transformer or inductors 170 are used for noise suppression. The diode 166 is used to prevent high voltage spikes from damaging the transistor 164. The resistor 162 insures that, when transistors 154 or 158 are not conducting, transistor 164 is off.

The power to the pre-amplifier and comparator section of the control circuit is supplied via a separate power supply 148 through switch 146 operated by the play button on the recorder. This voltage is isolated from the audio amplifier section by resistor 144 and capacitor 142. The power supply to the motors comes from battery 14 through a switch 180 which in turn powers motors 22 and 16 continuously. The capacitor 178 is used to suppress noise generated by these motors.

Referring again to FIGS. 2 and 3, the movement of the mouth 222 will now be described. The uni-directional DC motor 172 is specifically designed for a low inertia, high torque characteristic so that it can be quickly started and stopped to facilitate the mouth movement with the sound generation. The output shaft of the motor is connected through a speed reducer belt 202 to a combination pulley pinion gear member 204. A gear reduction assembly (not shown) extends from element 204 to drive the cam member 206. The gear assembly reduces the output of the motor 172 to permit the mouth to move, with fresh batteries, at approximately six cycles per second. When the batteries are at the end of their operative range, the mouth movement may be reduced in half to approximately three cycles per second. The cam 206 has a tracking groove 212 that provides a variable opening of the mouth. As can be seen, two lobes of the cam groove 212 can provide a full extension in the movement of a cam follower 208 while the other two lobes will provide a half movement to the mouth. By alternating the movement of the mouth from a full motion to a half motion, a more realistic movement is created. The cam follower 208 has a pin 210 that extends within the cam track 212 for transmitting the rotary motion of the cam member 206 to a linear motion through the cam follower 208. A binary feedback switch 150 can provide either an open or closed mouth condition as previously described. A flexible link 214 having the same safety characteristics as the other flexible links 42 and 44 connects cam follower 208 to a bell-crank 216 on mounting plate 50 that can move a lower metal rod 218 heat staked into the lower lip of mouth 222 relative to the upper imbedded rod 220 so that the lips and particularly the lower lip on the mouth 222 of the doll will move.

Figure 4:
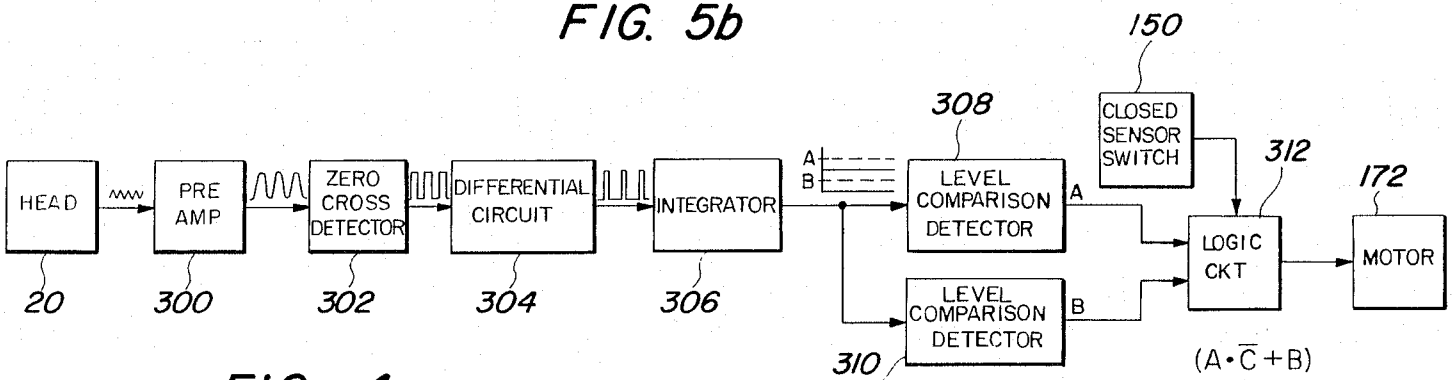
FIG. 4 is a schematic block diagram of the control circuit of the present invention.

Referring to FIG. 4, a schematic of the control circuit for motor 172 to move the animated features of the mouth on the doll head is disclosed. The pickup head 20 senses the frequency level encoded on a magnetic tape track and passes the signal to a pre-amplifier circuit 300. The output from the pre-amplifier is provided to a zero cross detector circuit 302 which digitizes the sensed frequency timing signal and provides an output to a differential circuit means 304 for quantizing the timing signal. The output from a differential circuit is then integrated by the integrating circuit 306 to provide a voltage level output which can be appropriately detected by one of the two level comparison detectors 308 and 310. The respective output from these level detector circuits along with the binary feedback signal from the switch 150 is applied to a logic circuit 312 which in turn controls the power to the motor 172.

In encoding the control track on the magnetic tape 9 with the control or timing signals for the motor 172, only a base frequency and a pair of coordinated constant frequency timing signals are utilized. The base frequency is set below the threshold of the range of the first level timing signal f1 that can, for example, be defined within the following inequity:

$$250hz < f1 > 750hz \quad (1)$$

The base frequency can actually be zero but is preferably positioned below and adjacent the minimum value of the range of f1 to facilitate a fast response in the control circuit.

The second level timing signal can be any frequency above 750 hz as shown by the following inequity:

$$f2 > 750hz \quad (2)$$

as long as that frequency is within the operative range of the pickup head and pre-amplifier circuit. Thus, it can be appreciated that the present encoding system and the resultant operation for the control circuit simply depends upon a level difference since it is basically digital or binary in nature and is interested in establishing either an "on" or "off" condition to its motors. The specific position of the mouth 222 is not particularly important, and in fact upon the cessation of the second level timing signal, the mouth can be either opened or closed since ther is no feedback servo loop monitoring the instantaneous position of the mouth 222. The first level timing signal has the capacity to drive the motor 172 until the binary feedback switch 150 indicates that the mouth is in the closed position. When the mouth is in the closed position, the driver transistor 154 is shunted and the presence of the first timing signal from the comparator 138 is unable to drive the motor 172. The output, however, of the comparator 132 bypasses the feedback switch 150 and is capable of driving the mouth motor 172 continuously. It should be noted, that the arrangement of the control circuit is based on a difference in frequency signal level as opposed to a specific analogue frequency range. Additionally, when the second frequency is present, the second frequency signal will inherently contain the first frequency of the first level timing signal. The arrangement of the control circuit, however moots the effect of the first timing signal when the second timing signal is present.

The first timing signal is particularly useful in the encoding of the tape 9 to control or limit the movement of the mouth 222, particularly when the batteries 14 are fresh. As mentioned earlier, the duty cycle of the batteries 14 can create a variation of from six cycles to three cycles per second movement of the mouth. By relying upon the first frequency signal f1, it is possible to drive the mouth 222 to a closed position with fresh batteries to thereby avoid excessive mouth movement in correlation with the audio signals.

Figure 6:
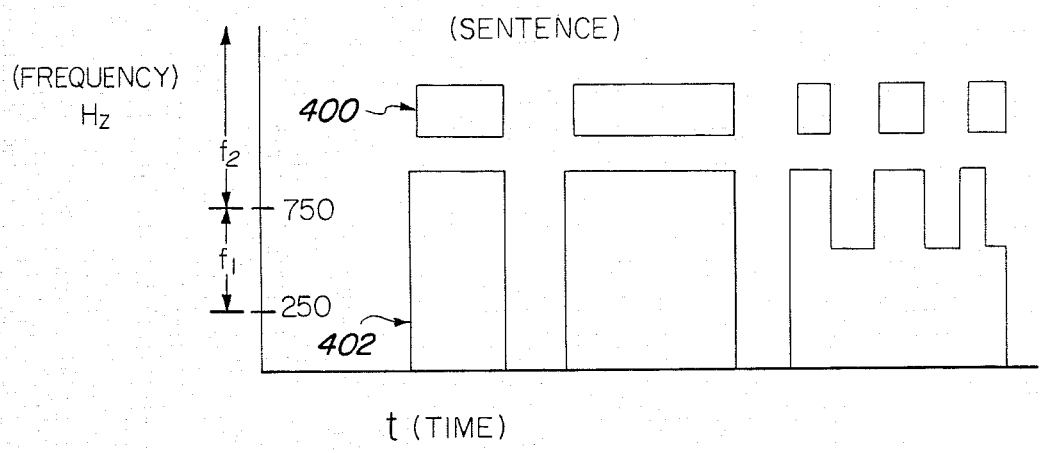
FIG. 6 is an encoding and timing schematic diagram for explanation purposes.

An example of a timing chart is disclosed in FIG. 6 wherein an audio sentence 400 can be subdivided into blocks of sound consisting individually of one or more words. The audio signal on the track of the magnetic tape will carry these words to be picked up by the pickup head 18. Due to the inertia in the movement of the mouth 222 and its mechanical linkage, the present invention contemplates providing the timing signals f1 and f2 on the other track of the magnetic tape to start approximately 3/10 of a second before an audio signal. As can be seen from the envelope of the frequency signals 402, the respective first frequency timing signal f1 and second frequency timing signal f2 need only be above or below certain levels to achieve the purposes of the present invention. The use of the first frequency signal f1 to drive the mouth 222 closed is shown in the audible sounds at the right of the graph. In the first two blocks of sound simply the cessation of the second frequency signal f2 is relied upon to cease movement of the mouth 222. The configuration and shape of the mouth on the doll is such, that whether the mouth 222 is in a fully open position, a half open position or a closed position will not create an unnatural appearance, and in fact, out control circuit is unable to determine the status of the mouth upon the cessation of the second frequency timing signal. A desired closing of the mouth 222 can be accomplished solely with the first timing frequency signal f1 that operates in correlation with the binary feedback switch 150. Thus, variations in power will not detract from the realistic animated features of the doll of the present invention. Additionally, a relatively simple and unprecise frequency level encoding method can be utilized with tape cartridge 9.

It is to be further understood that various modifications of the generic concepts of this invention are possible without departing from its spirit and accordingly the scope of the present invention should be determined solely from the following claims.

What is claimed is:

1. An animated audio doll driven from a power supply such as batteries comprising:

a doll body having a head member with simulated eyes and a mouth that can open and close;

motor means connectable to the power supply for moving the mouth to simulate production of audible sounds by the doll;

means for storing audio sounds to be reproduced by the doll;

means for converting a frequency signal to a digital signal level to enable the motor means to one of an on or off condition including a first level timing signal to drive the motor means for moving the mouth to a closed position from any open position of the mouth in coordination with the production of sound from the audio storing means and a second level timing signal to continually drive the motor means for moving the mouth so that it cyclically opens and shuts despite the presence of the first level timing signal, said second timing level signal cancelling the effect upon said motor means of said first level timing signal when said second level timing signal is present;

means for storing the level timing signals for retrieval in coordination with the stored audio sounds, and means for producing the audio sounds and level timing signals whereby the level timing signals can be pre-encoded for storage in a predetermined relationship to the audio sounds to control the mouth movement during simulated audio reproduction by the doll.

2. The invention of claim 1 further including a feedback means for sensing the position of the mouth in a closed position to provide a binary feedback signal consisting of either an open or a closed mouth condition to indicate when the first timing signal will drive the motor means.

3. The invention of claim 1 where the means for converting a frequency signal includes a pickup head for sensing the timing signals, a pre-amplifier means for amplifying the sensed timing signals, a zero crossover detector means for digitizing the sensed timing signal, a differential means for quantizing the timing signal, an integrating circuit means for integrating the timing signal to a voltage level, a level detector means for determining whether the first or second timing signal is present and a logic circuit means for applying the first timing signal to enable the motor means if only that first timing signal is present or to apply the second timing signal to enable the motor means if the second timing signal is present.

4. The invention of claim 1 wherein the timing signals are stored for retrieval by the producing means prior to the retrieval of the coordinate audio sound.

5. The invention of claim 1 wherein the first timing signal is a first frequency (f1) within the range of:

$$250hz < f1 < 750hz.$$

6. The invention of claim 1 wherein the second timing signal is a second frequency (f2) within the range of:

$$f2 > 750\ hz.$$

7. The invention of claim 1 wherein the motor means is a uni-directional direct current motor.

8. The invention of claim 1 wherein the means for storing the level timing signals consists of a tape cartridge encoded with audio signals, a base frequency and a pair of coordinated frequency timing signals, the timing signals including only a first frequency to be detected as the first level timing signal to drive the motor means to close the mouth from any open position and only a second frequency to be detected as the second level timing signal to continuously drive the motor means to cyclically upon and close the mouth despite the presence of the first level timing signal whereby the timing signals can be pre-encoded for storage relative to the audio sounds to control the mouth movement during simulated audio production.

9. The invention of claim 1 wherein the motor means includes an elongated flexible link that is connected to the mouth and is relatively rigid during any normal driven movement of the mouth but has specific design flexibility and is positioned in a path of unrestrained freedom of movement in the head member to bend sufficiently to absorb any driven displacement if the mouth is restrained from movement whereby the motor means can continue to safely function without damage.

10. The invention of claim 9 further including means for mounting the simulated eyes in the head member to provide vertical and horizontal coordinated movement and a second motor means for driving the eyes through a vertical and horizontal eye movement displacement, including at least a pair of elongated flexible links that are connected to the eyes, the respective links are relatively rigid during any normal driven movement of the eyes but have a specific design flexibility and are positioned in a path of unrestrained freedom of movement in the head member to bend sufficiently to absorb any driven displacement if the eyes are restrained from movement whereby the second motor means can continue to safely function without damage.

11. The invention of claim 10 where the means for converting a frequency signal includes a pickup head for sensing the timing signals, a pre-amplifier means for amplifying the sensed timing signals, a zero crossover detector means for digitizing the sensed timing signal, a differential means for quantizing the timing signal, an integrating circuit means for integrating the timing signal to a voltage level, a level detector means for determining whether the first or second timing signal is present and a logic circuit means for applying the first timing signal to enable the motor means if only that signal is present or to apply the second timing signal to enable the motor means if it is present.

12. The invention of claim 11 further including a feedback means for sensing the position of the mouth in a closed position to provide a binary feedback signal consisting of either an open or a closed mouth condition to indicate when the first timing signal will drive the motor means.

13. The invention of claim 12 wherein the means for storing the level timing signals consists of a tape cartridge encoded with audio signals, a base frequency and a pair of coordinated frequency timing signals, the timing signals including only a first frequency to be detected as the first level timing signal to drive the motor means to close the mouth from any open position and only a second frequency to be detected as the second level timing signal to continuously drive the motor means to cyclically open and close the mouth despite the presence of the first level timing signal whereby the timing signals can be pre-encoded for storage relative to the audio sounds to control the mouth movement during simulated audio production.

14. The invention of claim 13 wherein the motor means and the second motor means are mounted in the doll body and the flexible links connected to respectively the mouth and the eyes consist of the only driven members extending from the body into the head member.

15. The invention of claim 14 wherein the motor means and the second motor means include uni-directional direct current motors.

16. The invention of claim 15 wherein the timing signals are stored for retrieval by the producing means prior to the retrieval of the coordinate audio sound.

17. The invention of claim 16 wherein the first timing signal is a first frequency (f1) within the range of:

$$250hz < f1 < 750hz.$$

18. The invention of claim 17 wherein the second timing signal is a second frequency (f2) within the range of:

$f2 > 750hz$.

19. The invention of claim 15 further including a compound cam member and a pair of cam followers connected between the flexible links of the eyes and the second motor means.

20. In an animated audio doll having a head member with simulated eyes and a mouth that can simulate the production of sounds characteristic of that doll, means for driving the mouth, and a sound producing device such as a tape player that can receive different tape cassettes for reproducing the sound, the improvement comprising:

means for storing frequency level timing signals to activate the driving means including a first frequency timing signal to drive the driving means to close the mouth if in any open position and a second frequency timing signal to continually drive the driving means for the duration of the second timing signal so that it cyclically opens and shuts regardless of the presence of a first timing signal, the second timing signal cancelling the effect upon the driving means of the first timing signal when the second timing signal is present, and means for producing the audio sounds and the timing signals including means for converting the frequency timing signal to a digital signal level to enable the driving means to one of an on or off condition whereby the timing signals can be pre-encoded for storage relative to the audio sounds to control the mouth movement during simulated audio production.

21. The invention of claim 23 where the means for producing the timing signals includes a pickup head for sensing the signals, a pre-amplifier circuit means for amplifying the sensed timing signals, a zero crossover detector circuit for digitizing the sensed timing signal, a differential circuit means for quantizing the timing signal, an integrating circuit means for integrating the timing signal to a voltage level, a level detector circuit means for determining whether the first or second timing signal is present and a logic circuit means for applying the first timing signal to the drive means if only that signal is present or to apply the second timing signal to the drive means if it is present.

22. The invention of claim 21 wherein the frequency level timing signals are stored for retrieval by the producing means prior to the retrieval of the coordinate audio sound.

23. The invention of claim 21 wherein the first timing signal is a first frequency (f1) within the range of:

$250hz < f1 < 750hz$.

24. The invention of claim 21 wherein the second timing signal is a second frequency (f2) within the range of:

$f2 > 750hz$.

25. The invention of claim 21 wherein the means for storing the level timing signals consists of a tape cartridge encoded with audio signals, a base frequency and a pair of coordinated frequency timing signals, the timing signals including only a first frequency to be detected as the first level timing signal to drive the motor means to close the mouth from any open position and only a second frequency to be detected as the second level timing signal to continuously drive the motor means to cyclically open and close the mouth despite the presence of the first level timing signal whereby the timing signals can be pre-encoded for storage relative to the audio sounds to control the mouth movement during simulated audio production.

26. In an animated audio doll for simulating a living object with audio characteristics having a body with a head member with a simulated mouth that can open and close, motor means for driving the simulated mouth and player means for reproducing characteristic audio sounds and coordinated signals to move the mouth during audio production including the digitizing, differentiation and integration of the signals to provide an output for a level detector, the improvement consisting of:

a tape cartridge encoded with audio signals, a base frequency and a pair of coordinated frequency timing signals, the timing signals including only a first frequency to be detected as a first level timing signal to drive the motor means to close the mouth from any open position and only a second frequency to be detected as a second level timing signal to continuously drive the motor means to cyclically open and close the mouth despite the presence of the first level timing signal whereby the timing signals can be pre-encoded for storage relative to the audio sounds to control the mouth movement during simulated audio production, said second timing level signal cancelling the effect upon said motor means of said first level timing signal when said second level timing signal is present.

27. The invention of claim 26 wherein the frequency timing signals are stored for retrieval by the player producing means prior to the retrieval of the coordinate audio sound.

28. The invention of claim 27 wherein the first timing signal is a first frequency (f1) within the range of:

$250hz < f1 < 750hz$.

29. The invention of claim 28 wherein the second timing signal is a second frequency (f2) within the range of:

$f2 > 750hz$.

30. An animated audio toy capable of playing replaceable tape cartridges encoded with audio signals and capable of reproducing these signals and a pair of frequency coordinated timing signals comprising:

a toy body having a head member with a mouth that can open and close;

motor means connectable to a power supply for moving the mouth to simulate the production of audible sounds by the toy;

means for reproducing the audio sounds from the audio signals;

means for converting timing frequency signals to digital signal levels to enable the motor means to one of an on or off condition including means for permitting a first level timing signal to drive the motor means for moving the mouth to a closed position from any open position of the mouth in coordination with the production of sound from the reproducing means and means for permitting a second level timing signal to continually drive the motor means for moving the mouth so that it cyclically opens and shuts, said second timing level signal cancelling the effect upon said motor means of said first level timing signal when said second level timing signal is present, and means for detecting the level timing signals for retrieval in coordination with the audio sounds, whereby the level timing signals can be pre-encoded for storage relative to the audio sounds to control the mouth movement during simulated audio production by the doll.

31. The invention of claim 30 wherein the motor means includes an elongated flexible link that is connected to the mouth and is relatively rigid during any normal driven movement of the mouth but has a specific design flexibility and is positioned in a path of unrestrained freedom of movement in the head member to bend sufficiently to adsorb any driven displacement if the mouth is restrained from movement whereby the motor means can continue to safely function without damage.

32. The invention of claim 30 further including a feedback means for sensing the position of the mouth in a closed position to provide a binary feedback signal consisting of either an open or a closed mouth condition to indicate when the first timing signal will drive the motor means.

33. The invention of claim 31 further including means for mounting the simulated eyes in the head member to provide vertical and horizontal coordinated movement and a second motor means for driving the eyes through a vertical and horizontal eye movement displacement, including at least a pair of elongated flexible links that are connected to the eyes, the respective links are relatively rigid during any normal driven movements of the eyes but have a specific design flexibility and are positioned in a path of unrestrained freedom of movement in the head member to bend sufficiently to absorb any driven displacement if the eyes are restrained from movement whereby the second motor means can continue to safely function without damage.

34. The invention of claim 31 wherein the motor means is a uni-directional direct current motor.

35. The invention of claim 32 where the means for converting timing frequency signals includes a pre-amplifier means for amplifying the sensed timing signals, a zero crossover detector means for digitizing the sensed timing signal, a differential means for quantizing the timing signal, an integrating circuit means for integrating the timing signal to a voltage level, a level detector means for determining whether the first or second timing signal is present and a logic circuit means for applying the first timing signal to enable the motor means if only that signal is present or to apply the second timing signal to enable the motor means if it is present.

* * * * *